US007780405B2

(12) United States Patent
Araki

(10) Patent No.: US 7,780,405 B2
(45) Date of Patent: Aug. 24, 2010

(54) BLOWER SYSTEM HAVING A COOLING PASSAGE

(75) Inventor: Yoshinori Araki, Chiryu (JP)

(73) Assignee: Denso Corporation, Kariya (JP)

( * ) Notice: Subject to any disclaimer, the term of this patent is extended or adjusted under 35 U.S.C. 154(b) by 874 days.

(21) Appl. No.: 11/647,464

(22) Filed: Dec. 28, 2006

(65) Prior Publication Data

US 2007/0147995 A1 Jun. 28, 2007

(30) Foreign Application Priority Data

Dec. 28, 2005 (JP) ..... 2005-379552
Oct. 13, 2006 (JP) ..... 2006-280358

(51) Int. Cl.
*F04B 39/06* (2006.01)

(52) U.S. Cl. ..... 415/204; 415/206; 415/214.1; 417/366; 417/369; 417/423.15; 310/63

(58) Field of Classification Search ..... 415/204, 415/206, 213.1, 214.1; 417/366, 369, 423.14, 417/423.15; 310/62, 63
See application file for complete search history.

(56) References Cited

U.S. PATENT DOCUMENTS 6,552,457 B2 4/2003 Uruma et al.
6,604,906 B2 * 8/2003 Ozeki et al. ..... 415/204
6,802,699 B2 * 10/2004 Mikami et al. ..... 417/369
6,964,555 B2 * 11/2005 Ochiai et al. ..... 415/204
7,011,506 B2 * 3/2006 Kim ..... 417/366

FOREIGN PATENT DOCUMENTS

JP 63-105466 7/1988
JP 2002-347428 12/2002
JP 2008-083772 3/2006

OTHER PUBLICATIONS

Office Action dated May 9, 2008 in Chinese Application No. 2006 10172516.X with English translation.

* cited by examiner

*Primary Examiner*—Christopher Verdier
(74) *Attorney, Agent, or Firm*—Harness, Dickey & Pierce, PLC

(57) ABSTRACT

A blower system, wherein a blower case and a motor holding housing are comprised as separate members, a spiral casing is provided with an enlarged part enlarged in an axial direction to an opposite side from the suction port from a centrifugal type blower fan. The motor holding housing is provided with a holder storing and holding the motor, an extension extending from the holder in a diametrical direction of the fan, a circumferential wall connected with the extension and forming an inner circumferential wall of the enlarged part in the spiral casing. A cooling air passage is provided between the holder and the circumferential wall to guide part of the air circulating inside the spiral casing to the motor. The cooling air passage has an inlet into which air flows from the spiral casing and an outlet at the circumferential wall, out of which air flows to the motor.

8 Claims, 7 Drawing Sheets

BLOWER SYSTEM HAVING A COOLING PASSAGE

BACKGROUND OF THE INVENTION

1. Field of the Invention

The present invention relates to a blower system for a vehicular air-conditioning system etc.

2. Description of the Related Art

In general, a vehicular air-conditioning system is provided at the front of the front seats in the passenger compartment. It has an intake having a blower system for obtaining air from inside and outside of the compartment, a cooler for cooling the obtained air, and a heater for heating the cooling air.

The blower system provided at the intake is also disclosed in Japanese Patent Publication (A) No. 2002-347423. For example, as shown in FIG. 10, it has a blower case 1 in which a centrifugal type blower fan F is housed and a motor M driving the blower fan F. When this motor 14 drives the blower Fan F, the air inside the compartment or the air outside the compartment is selectively taken into the blower case 1 from an intake port 3 (also called a "bellmouth") and flows from a discharge port (not shown) of the blower case 1 toward the later cooler or heater.

In this blower system, the blower case 1 and the motor M are connected by a cooling air passage 4. Part of the air flowing through a spiral casing 1*a* is guided into the motor M as cooling air and cools the motor M.

The blower case 1 is formed by upper and lower pieces P1 and P2 joined at a Parting line PL at an intermediate location in the motor axial direction. The lower piece P2 and the motor holding housing 2 holding the motor M are formed integrally. The cooling air passage 4 is comprised of a groove formed integrally in the lower piece P2 and covered by a cap from the fan F side. By configuring it in this way, the cooling air passage 4 from the inlet of the cooling air to the motor M can be formed by the shortest distance and the motor M can be efficiently cooled.

However, this blower system is an integral structure of the lower piece P2 of the blower vase 1 and the motor holding housing 2 joined together, so when the motor M has to be replaced, it becomes necessary to separate the upper piece P1 and lower piece P2 of the blower case 1 to remove the motor M. Usually, the blower case 1 is connected to the air-conditioning case having the cooler and heater, so when disassembling the blower case 1, it becomes necessary to disassemble the air-conditioning case and the maintenance efficiency becomes extremely poor.

If making the motor holding housing 2 and lower piece P2 separate, the above problem can be solved, but Japanese Patent Publication (A) no. 2002-347428 provides a cooling air passage 4 between the inner side of the blower case 1 and the motor M, so the lower piece P2 of the blower case 1 and the motor holding housing 2 must be made integral in structure.

SUMMARY OF THE INVENTION

An object of the present invention is to provide a blower system which is easy to maintain and obtains motor cooling air from the inside of the spiral casing.

The present invention provides a blower system as means for achieving this object. According to the present invention, there is provided a blower system (100) provided with a centrifugal type blower fan (F) for blowing air, taken in through a suction port from the axial direction, to the outside in the diametrical direction, a motor (M) for driving rotation of the centrifugal type blower fan, a blower case (1) in which is formed a spiral casing (1*a*) guiding air sent by the centrifugal type blower fan outward in the diametrical direction to a discharge port, and a motor hold no housing (2) for holding the motor, the blower case (1) and the motor holding housing (2) being comprised as separate members, the spiral casing (1*a*) being provided with an enlarged part (1*b*) enlarged in an axial direction to an opposite side from the suction port from the centrifugal type blower fan, the motor holding housing being provided with a holder (2*d*, 2*p*) storing and holding the motor, an extension (2*h*) extended from the holder in a diametrical direction of the fan, a circumferential wall (2*c*) formed connected with the extension and forming an inner circumferential wall of the enlarged part in the spiral casing, and a cooling air passage (4) provided between the holder and the circumferential wall and guiding part of the air circulating inside the spiral casing as cooling air (x) to the motor, and the cooling air passage (4) having an inlet opening (2*a*) into which air flows from the spiral casing and having an outlet opening (2*b*) provided at the circumferential wall and out of which air flows to the motor.

In the blower system, the blower case and the motor holding housing are comprised as separate members, so when replacing the motor, there is no need to disassemble the blower case 1. The motor can be easily replaced by detaching the motor holding housing to which the motor is mounted from the blower case. Further, due to the above cooling air passage structure, the ease of motor replacement can be maintained and motor cooling air can be obtained from the inside of the spiral casing.

Preferably, the inlet opening (2*a*) is provided with inclined walls (2*f*) formed inclined with respect to the diametrical direction so as to enlarge the cross-sectional area of the passage toward the outside in the diametrical direction of the spiral casing (1*a*) and guiding the cooling air (x). Due to this, part of the air circulated through the inside of the spiral casing easily flows into the cooling air passage and as a result the flow rate of the cooling air can be made larger.

More preferably, the cooling air passage (4) is provided with a partition wall (2*g*) formed continuing with the extension (2*h*) and covering the blower fan side of the cooling air passage. Due to this, it is possible to prevent the sound of the stream of air striking the cooling air and to increase the cooling air low rate.

Still-more preferably, the partition wall (2*g*) extends from a location (2*s*) where two inclined walls (2*f*) approach each other the closest to an axial center side of the motor.

Still more preferably, the holder (2*d*, 2*p*) has side walls (2*d*) holding sides of the motor and a floor (2*p*) holding the motor bottom, the outlet opening (2*p*) is provided near the floor, and the cooling air passage (4) is provided with a first passage (2*j*) extending from the inlet opening toward the side walls of the holder and a second passage (2*k*) connected with the first passage, extending along the side walls of the holder, and leading to the outlet opening.

Still more preferably, an end (2*s*) of the partition wall (2*g*) at the spiral casing (1*a*) side and an axial center end (25) of the first passage floor (2*n*) forming the first passage (2*j*) are positioned on the same plane parallel to the axial direction of the motor. Due to this, when molding the motor holding housing from a resin, there is no need to use a slide mold and there is no need to use a separate member for forming the cooling air passage.

Still more preferably, the second passage (2*k*) is formed with an opening (2*u*) at an opposite side from the blower fan, the opening is provided with a lid (2*l*) and an end (2*s*) of the partition wall at the spiral casing side and an end (2*y*) of the opening at the spiral casing side are positioned on the same plane parallel to the axial direction of the motor. Due to this, when molding the motor holding housing from a resin, there is no need to use a slide mold and there is no need to use a separate member for forming the cooling air passage.

Still more preferably, the inlet opening (2*a*) is arranged between a spiral start (1*x*) and a spiral end (1*y*) of a spiral shape forming a functional part of the spiral casing (1*a*) and corresponding to a position shifted from the spiral start (1*x*) to the spiral end (1*y*) in a direction (−θ) opposite to the spiral direction (+θ). Due to this, it becomes possible to further increase the cooling air flow rate.

Still more preferably, a bottom (1*b*) of the spiral casing (1*a*) is formed on the same plane perpendicular to the motor axis From the spiral start to spiral end of the spiral casing.

Note that the reference numerals in the parentheses following the above means show the correspondence with the specific means described in the embodiments explained later.

BRIEF DESCRIPTION OF THE DRAWINGS

These and other objects and features of the present invention will become clearer from the following description of the Preferred embodiments given with reference to the attached drawings, wherein.

DESCRIPTION OF THE PREFERRED EMBODIMENTS

Below, embodiments of the present invention will be explained based on the drawings.

First Embodiment

Figure 1:
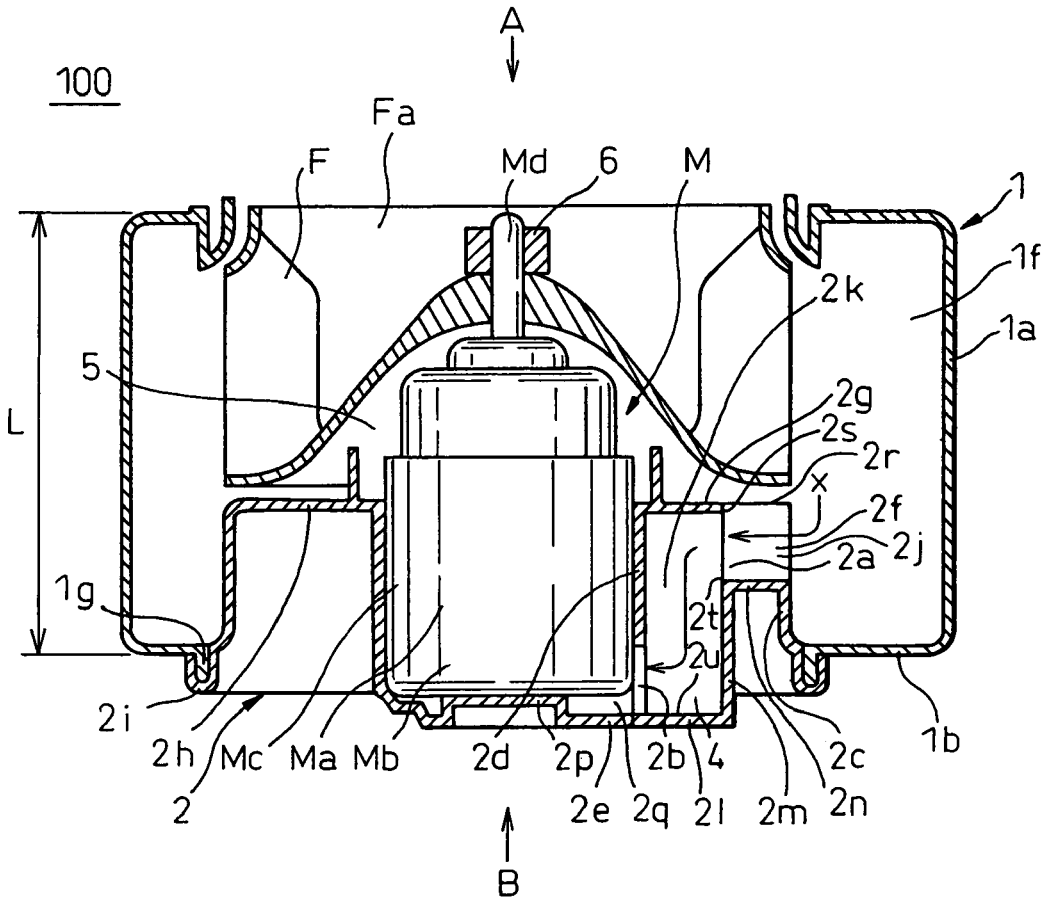
FIG. 1 is a cross-sectional view of a blower system according to a first embodiment of the present invention.
Figure 2:
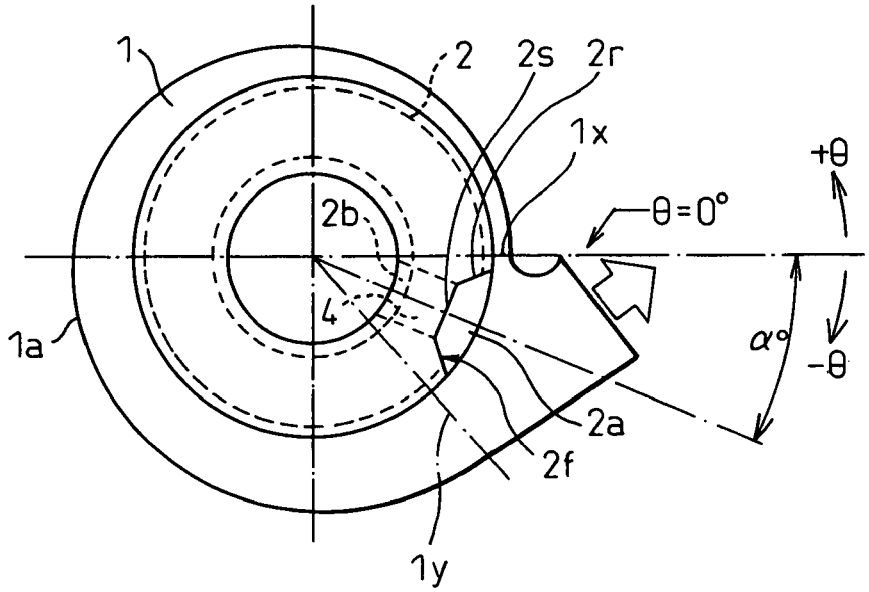
FIG. 2 is a schematic too View of a blower system seen from the direction A in FIG. 1.
Figure 3:
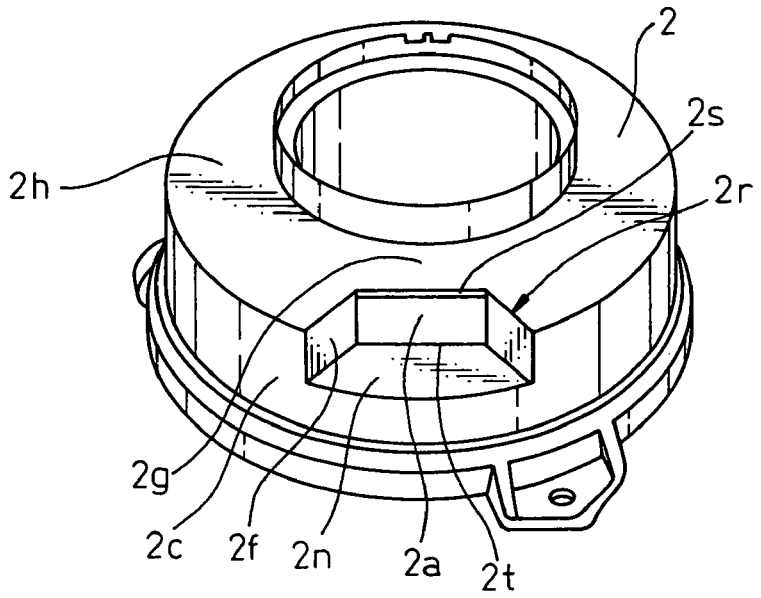
FIG. 3 is a perspective view of a motor holding housing of a blower system according to the first embodiment of the present invention.

FIG. 1 is a cross-sectional view of a blower system according to a first embodiment of the present invention, FIG. 2 is a schematic top view of a blower system as seen from the direction A in FIG. 1, and FIG. 3 is a perspective view of a motor holding housing of a blower system according to the first embodiment of the present invention.

In FIG. 1, 100 indicates a blower system according to the present invent, F a centrifugal type blower fan, M a motor, 1 a blower case, 2 a rotor holding housing, 4 a cooling air passage, and 6 a fan fastening nut. 2*a*, 2*b*, 2*c*, 2*d*, 2*e*, 2*f*, and 2*g* show parts of the motor holding housing 2, where 2*a* shows an inlet opening, 2*b* an outlet opening, 2*c* a circumferential wall forming the spiral casing, 2*d* a side wall fastening and holding the motor side surface Mc, 2*e* a floor abutting against and holding the motor bottom Mb, 2*f* an inclined wall guiding the cooling air x, and 2*g* a partition wall. The blower case 1 and the motor holding housing 2 are separate members.

The blower system 100 is provided with a motor M, a centrifugal type multiblade blower fan F driven to rotate by the motor M and blowing air taken in through the suction port Fa outward in the diametrical direction, a blower case 1 having a spiral casing 1*a* surrounding this centrifugal type multiblade fan F and forming a spiral shaped air passage if through which air blown from the centrifugal type multiblade fare F is blown, and a motor holding housing 2.

The spiral casing 1*a* is provided with an enlarged part 1*b* expanding in an axial direction to an opposite side from the suction port Fa from the centrifugal type blower fan F and has an outer circumferential wall extended in parallel in the axial direction. The bottom 1*b* of the spiral casing 1*a* is formed on the same plane vertical to the motor shaft Md from the spiral start to spiral end of the spiral casino 1*a*. Further, the width L of the spiral casing 1*a* in the axial direction is substantially the same in the entire circumferential direction.

Further, the centrifugal type multiblade fan F is held at the substantial center of the spiral casing 1*a*. The motor M is fastened and held stored in the motor holding housing 2 placed at the substantial center of the spiral casing 1*a*. The shaft Md of the motor M is positioned at the approximate center of the spiral casing 1*a*. This shaft Md has the centrifugal type multiblade fan F connected to it by the fastening nuts 6.

Figure 6:
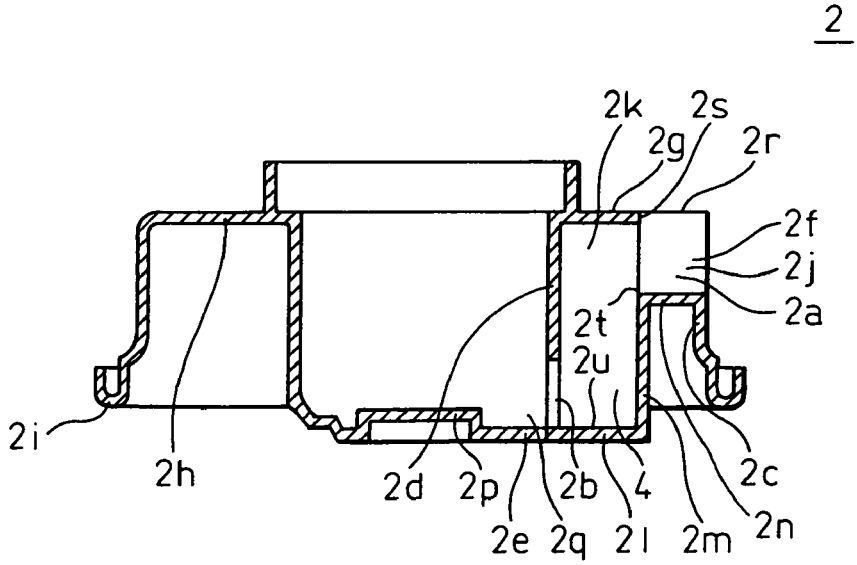
FIG. 6 is a cross-sectional views of a motor holding housing according to the first embodiment of the present invention.

As shown in FIG. 1 and FIG. 6, the motor holding housing 2 is provided with a holder (2*d*, 2*p*) provided at the opposite side to the suction port Fa and (directly holding the motor M. The holder (2*d*, 2*p*) is provided with a seat 2*p* for holding the bottom of the motor M and side walls 2*d* covering the outer circumference of the motor M. From the end of the side walls 2*d* at the blower fan F side, an extended wall 2*h* is integrally formed so as extend toward the spiral casing 1*a*. From the outer circumference of the end of the extended wall 2*h* at the spiral casing 1*a* side, a circumferential wall 2*c* functioning as an inner circumferential wall of the spiral casing 1*a* is integrally formed so as to extend in the direction opposite to the blower fan F. The circumferential wall 2*c* functions as the outer circumferential wall in the state of the motor holding housing alone.

Note that the length of this circumferential wall 2*c* in the direction opposite to the blower fan F is made the same along the entire circumferential direction. At the center of the floor 2*e* facing the bottom of the motor M, the seat 2*p* for holding the bottom of the motor M is formed. At the outer circumference of the seat 2*p*, a clearance 2*q* is formed between the bottom Mb of the motor M and the floor 2*e*. The motor holding housing 2 and the blower case 1 are connected boy engagement of a ring shaped projection 1*g* formed at the bottom of the blower case 1 and a ring shaped recess 2*i* formed at the end of the circumferential wall 2*c* of the motor holding housing 2.

Due to this, the motor holding housing 2 can be attached to and detached from the blower case 1 as an integral assembly of the floor 2*e* and side walls 2*d* for directly holding the motor M and the extended wall 2*h* and further the circumferential wall 2*c* forming part of the spiral casing 1*a*. Further, in the state with the motor holding housing 2 holding the motor M and with the blower fan F and motor M assembled, the blower fan F and motor M can be attached to and detached from the blower case 1 together with the motor holding housing 2. For this reason, the circumferential wall 2*c* forms part of the spiral casino 1*a* in the state with the motor holding housing 2 attached to the blower case 1, while functions as the outer circumferential wall of the motor holding housing 2 in the state with the motor holding housing 2 detached from the blower case 1. Further, when the motor M has to be replaced, there is no need to disassemble the blower case 1 like in Japanese Patent Publication (A) No. 2002-347428. It becomes possible to easily detach the motor 14 from the blower system 100.

Part of the blower case 1 forms the spiral casing 1*a*. The spiral casing 1*a* is formed so as to be expanded in the diametrical direction toward the discharge opening and forms a spiral shape as shown in FIG. 2. Inside this spiral casing 1*a*, air circulates after receiving centrifugal force from the blower fan F. Part of this air flow flows through the cooling air passage 4 in the illustrated arrow direction as cooling air x for cooling the motor M. The cooling air x first flows from the inlet opening 2*a* provided in the circumferential wall 2*c* to the inside of the cooling air passage 4, passes through the first passage 2*j* to strike the inside wall 2*d*, flows along the side wall 2*d*, is changed in direction to the floor 2*e* direction, and passes through the second passage 2*k*. The two ends of the inlet opening 2*a* in the fan rotation direction are provided with inclined walls 2*f* formed inclined with respect to the diametrical direction of the spiral casing so as to increase the passage cross-sectional area in the diametrical direction toward the outside and guide the cooling air x accordingly.

Meat, the cooling air x flows out from the outlet opening 2*b* provided near the floor 2*e* and at the side walls 2*d* and flows to near the motor bottom Mb. Further, the cooling air x passes from near the motor bottom Mb through the clearance (not shown) between the motor side surfaces Mc and the side walls 2*d* or through the inside of the motor housing Ma and rises toward the back space 5 of the blower fan F.

Due to the above, the cooling air x cools the motor bottom Mb, which first becomes highest in temperature, then cools the motor side surfaces Mc. Due to this, the motor M is evenly cooled.

Further, the first passage 2*j* forming the cooling air passage 4 is formed from the inclined walls 2*f* and circumferential wall 2*c* and a first passage floor 2*n* integrally formed with the same and extending toward the side walls 2*d*. The second passage 2*k* forming the cooling air passage 4 is comprised of a second passage floor 2*l* formed connected with the floor 2*e*, an outside wall 2*m* formed integrally with the first passage floor 2*n* and extending parallel to the side wall 2*d* in the axial direction of the motor M, and a partition wall 2*g*. The partition wall 2*g* extends from the location 2*s* where the two inclined walls 2*f* approach each other the closest to the axial center side of the motor M. The partition wall 2*g* forms part of the extended wall 2*h* and is formed connected with the extended wall 2*h* and covers the blower fan F side of the second passage 4. The end 2*s* of the partition wall 2*g* at the spiral casing 1*a* side and the outside wall 2*m* are positioned on the same plane parallel to the motor axial direction. That is, the end 2*s* of the partition wall 2*g* at the spiral casing 1*a* side and the end 2*t* of the first passage floor 2*n* forming part of the first passage 2*j* at the axial center side of the motor M are positioned on the same plane parallel to the motor axial direction.

Further, the outside wall 2*m* and the first passage floor 2*n* are integrally formed. Further, the partition wall 2*g* and side wall 2*d* are integrally formed. By this structure of the cooling air passage 4, the motor holding housing 2 can be made a compact design.

Figure 4:
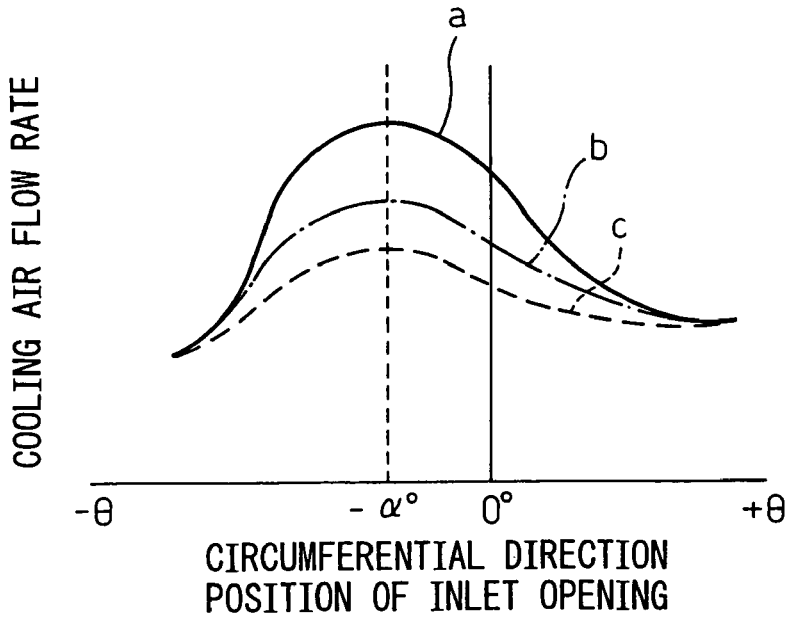
FIG. 4 is a graph of the relationship between the cooling air inlet opening and cooling air flow rate of a blower system according to the first embodiment of the present invention.

On the other hand, as shown in FIGS. 1 to 3, the inlet opening 2*a* is provided with the inclined walls 2*f* guiding the cooling air x. Due to this, the cooling air flow rate can be made larger. FIG. 4 is a graph of the relation of the inlet opening 2*a* end the cooling air flow rate. In FIG. 4, a is a graph of the case where the inlet opening 2*a* is provided with the inclined walls 2*f* and partition wall 2*g*, b is a graph of the case where the inlet opening 2*a* is provided with the inclined walls 2*f* and not provided with the partition wall 2*g*, and c is a graph of the case where the inlet opening 2*a* is not provided with the inclined walls 2*f* or the partition wall 2*g*. These are based on actual measurements. The ordinate in FIG. 4 indicates the cooling air flow rate, while the abscissa indicates the circumferential direction position of the inlet opening 2*a* (explained later). As will be understood from FIG. 4, in both the case a and b where the inclined walls 2*f* are provided, the flow rate is larger than the case c where they are not provided. Further, the case a where the partition wall 2*g* is provided is larger in flow rate than the case b where it is not provided. Further, it is understood that the inlet opening 2*a* provided with both the inclined walls and partition wall becomes greatest in cooling air flow rate.

Here, the circumferential direction position of the inlet opening 2*a* will be explained. The inlet opening 2*a* is provided in the motor holding housing 2. Further, as shown in FIG. 2, it is arranged corresponding to a position shifted slightly from a spiral start 1*x* and a spiral end 1*y* of the spiral shape forming the functional part of the spiral casing in a direction (−θ) opposite to the spiral direction (+θ). Due to this, the cool no air flow rate can be made further larger.

FIG. 4 shows the relationship between the circumferential direction position of the inlet opening 2*a* and the cooling air flow rate. When the circumferential direction position of the inlet opening 2*a* is α°, it is learned that the cooling air flow rate becomes larger.

Note that the partition wall 2*g* has the role of preventing the air engaged in free spiral motion in the spiral casing from striking the cooling air. If eliminating this, the air stream will strike the cooling air and cause noise or the cooling air flow rate will fall. Further, no partition wall is formed at the location 2*r* of the inclined wall 2*f* at the fan F side. This is because it is advantageous of intake of air. Further, a plurality of inlet openings 2*a* may also be provided.

Figure 5:
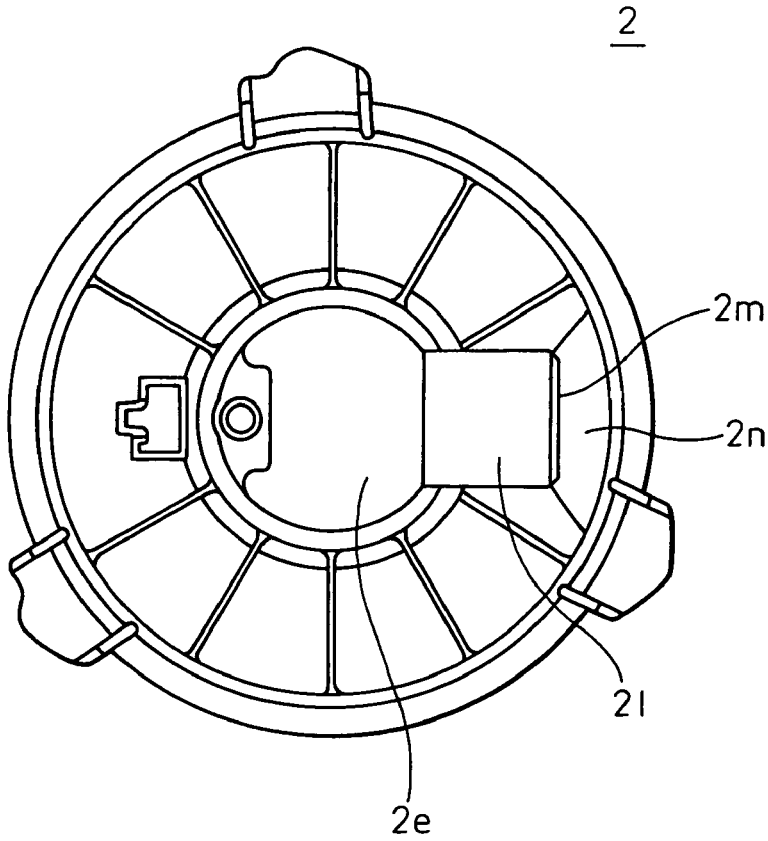
FIG. 5 is a bottom view of the motor holding housing as seen from the direction B in FIG. 1.

Next, the method of molding the resin of the motor holding housing 2 will be explained with reference to FIGS. 5 to 8. FIG. 5 is a bottom view of the motor holding housing as seen from the direction B in FIG. 1, FIG. 6 is a cross-sectional view of a motor holding housing according to the first embodiment of the present invention, FIG. 7 is a cross-sectional view of a motor holding housing according to the first embodiment of the present invention right after shaping the resin, and FIG. 8 is a resin shaping mold of a motor holding housing according to the first embodiment of the present invention.

The motor holding housing 2 is fabricated by the injection molding method using a thermoplastic resin such as polypropylene. This injection molding method uses the molds J and K as shown in FIG. 8 to fabricate the motor holding housing 2. J indicates an upper mold, K a lower mold, and L a cavity into which the resin melted by heat flows and solidifies.

When the molds J and K are combined, a cavity L sealed except at the gate opening and runner (both not shown) is formed. Next, the resin heated and melted in the cylinder of the injection molding machine (not shown) passes through the gate opening and runner and flows into and fills the cavity L. The resin filled in the cavity L is robbed of heat by the molds J and K and solidifies. After the resin solidifies, the molds J and K, as shown by the arrows in FIG. 8, are opened by moving the under mold J in the upper direction and moving the lower mold F in the lower direction. This mold opening operation enables the shaped article to which the shape of the cavity L is transferred, that is, the motor holding housing 2, to be taken out from the molds J and K.

Figure 7:
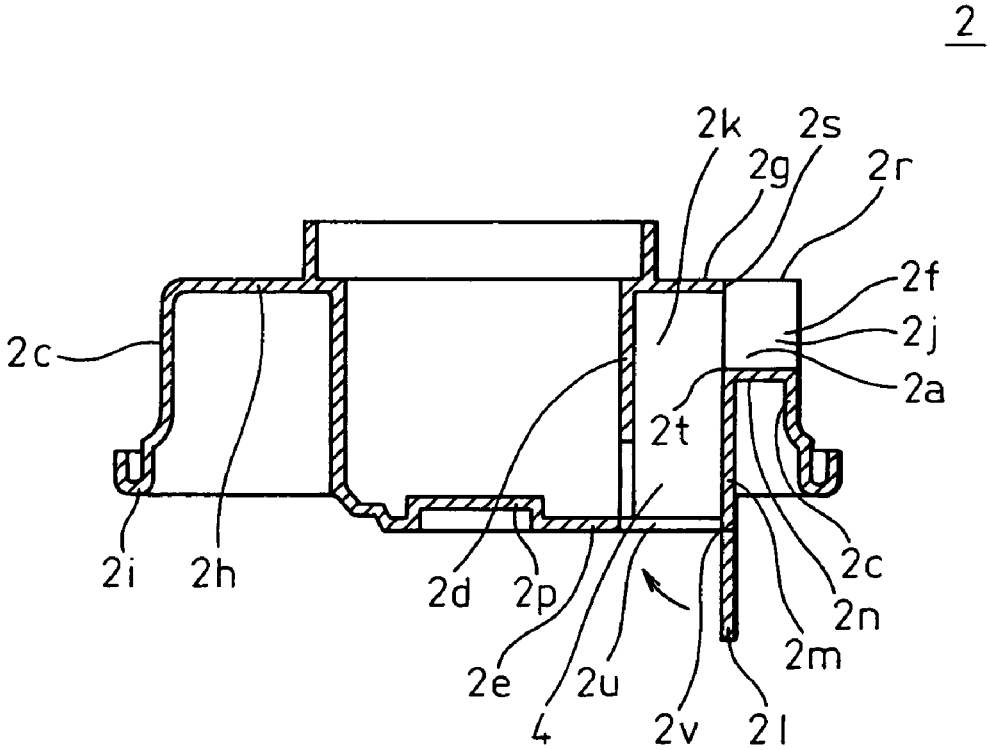
FIG. 7 is a cross-sectional view of a motor holding housing according to the first embodiment of the present invention right after shaping the resin.
Figure 8:
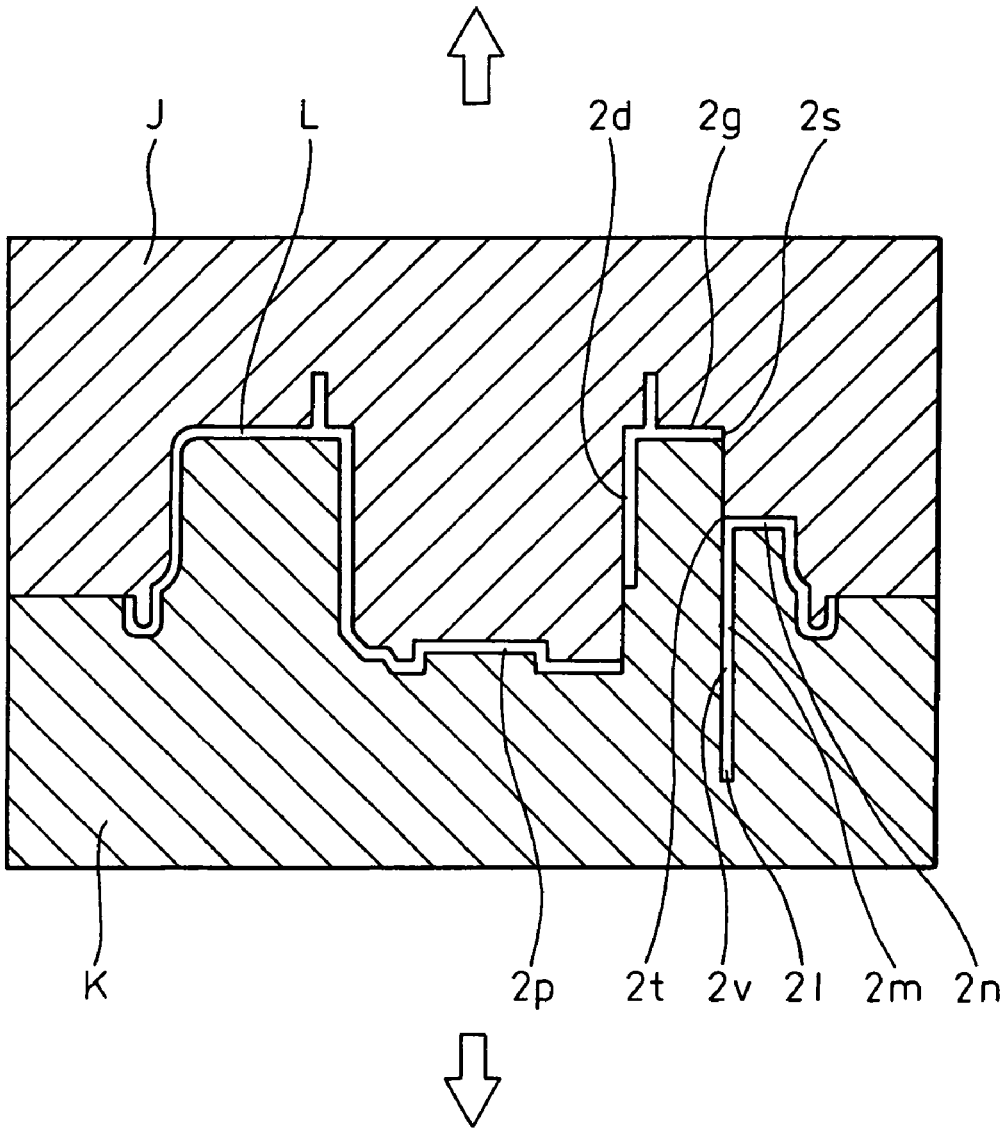
FIG. 8 is a resin shaping mold of a motor holding housing according to the first embodiment of the present invention.

The motor holding housing 2 right after being taken out from the molds J and K, as shown in FIG. 7, has the lid 2*l* for forming the second passage floor (see FIG. 5) and the outside wall 2*m* connected in a straight line. Next, the lid 2*l* of the motor holding housing 2 is bent in the arrow direction at the point 2*v* and connected to the floor 2*e* to close the opening 2*u*. The lid 2*l* can also be made a separate member.

The motor holding housing 2 of the present invention mainly has the following two shape features, so the shaping mold need only be made of the tapper mold J and lower mold K. That is, the first point is that the end 2*s* of the partition wall 2*g* at the spiral casing 1*a* side and the end 2*t* of the first passage floor 2*n* forming part of the first passage 2*j* at the axial center side of the motor M are positioned on the same plane parallel to the motor axial direction. The second point is that the second passage 2*k* is formed with an opening 2*k* at the opposite side from the blower fan F, the opening 2*k* is provided with a lid 2*l*, and the end 2*s* of the partition wall 2*g* on the spiral casing 1*a* side and the end 2*v* of the opening 2*k* on the spiral casing 1*a* side are positioned on the same plane parallel to the motor axial direction.

Figure 9:
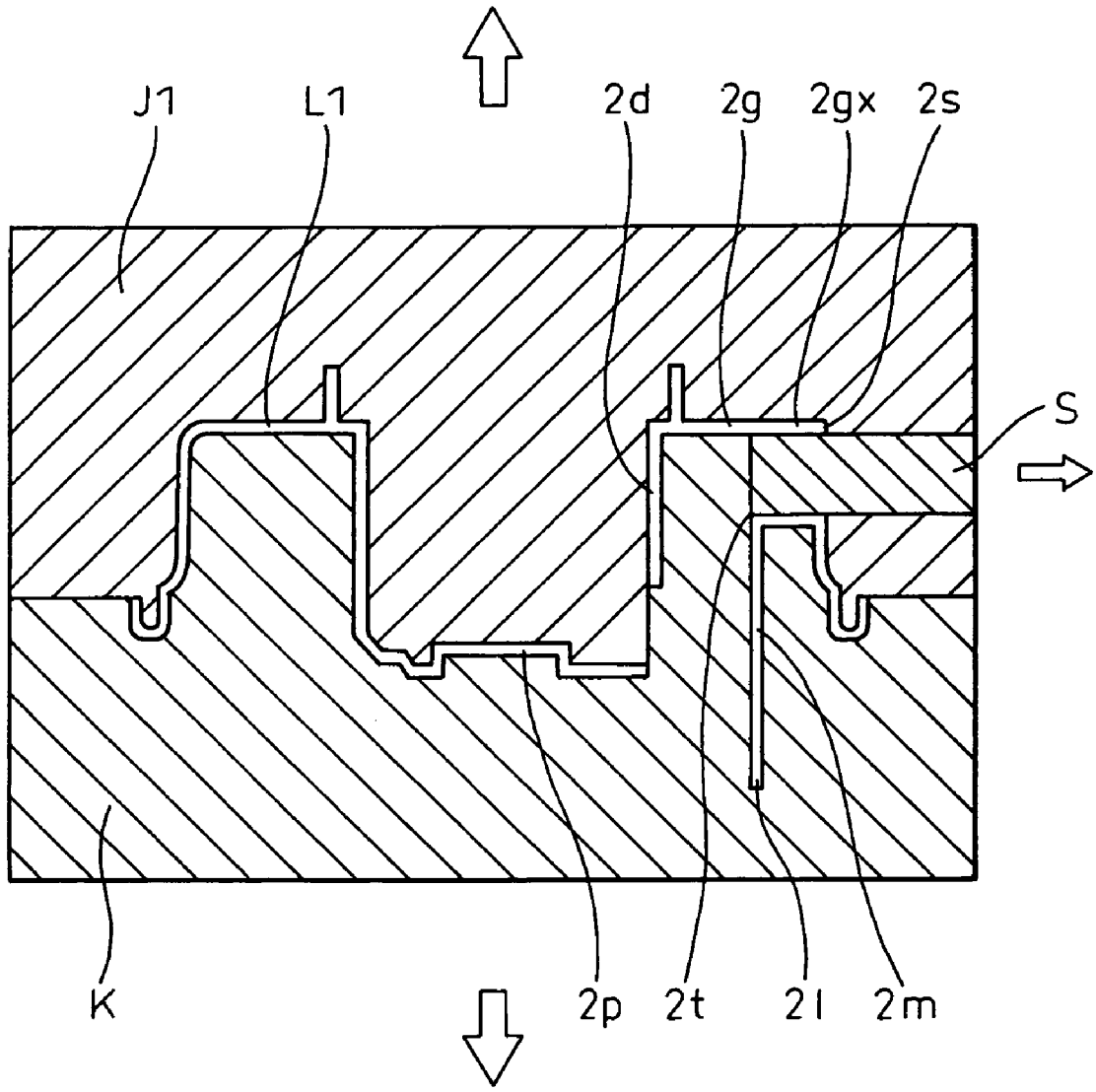
FIG. 9 is a resin shaping mold of a motor holding housing in the case where the length of the partition wall differs from the present invention.
Figure 10:
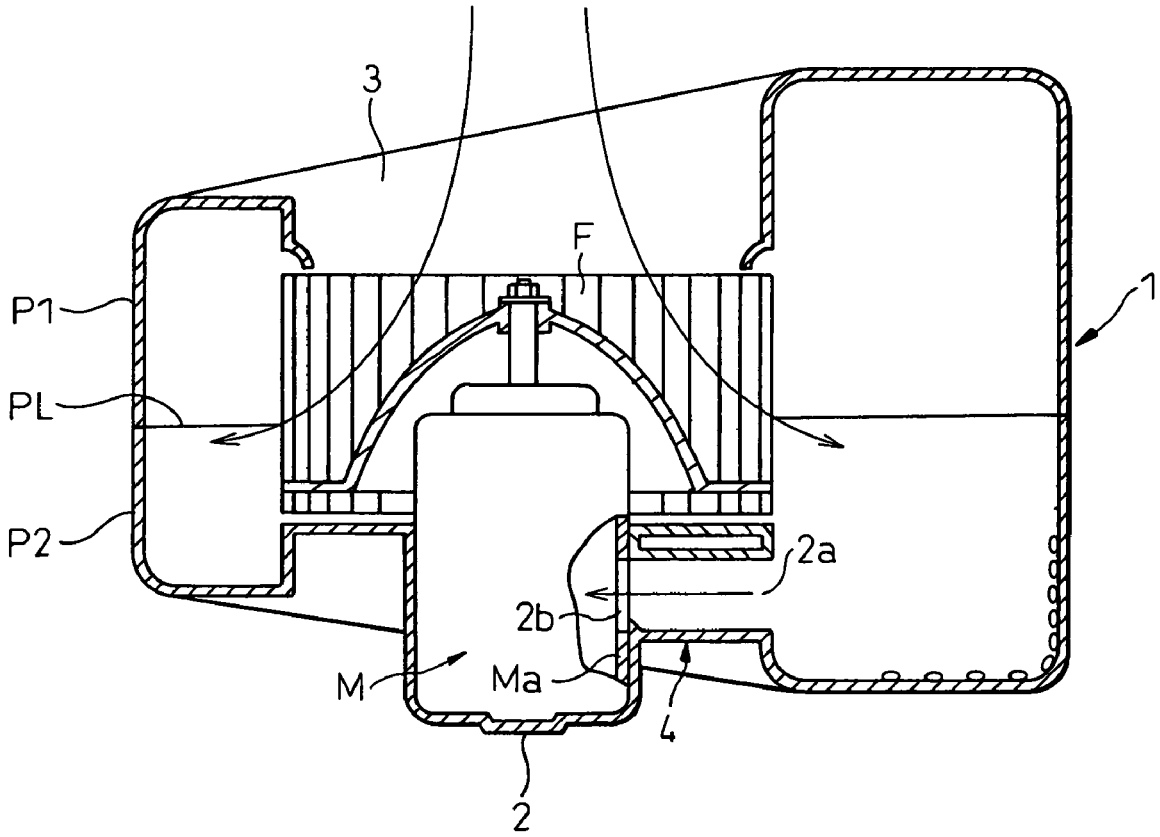
FIG. 10 is a cross-sectional view of a blower system of the related art.

The case where the first shape feature is not provided in the motor holdings housing 2 will be explained with reference to FIG. 9. FIG. 9 shows a shaping mold for a motor holding housing 2*x* where the end 2*s* of the partition wall 2*g* at the spiral casing 1*a* side extends further to the spiral casing 1*a* side than the end 2*t* of the first passage floor 2*n* forming part of the first passage 2*j* at the axial center side of the motor M.

The partition wall 2*g* has a part 2*gx* extending further to the spiral casing la side than the end 2*t* of the first passage floor 2*n* at the axial center side of the motor M. For this reason, the two molds can no longer be opened in the vertical direction, the slide mold S is necessary, and the mold structure becomes complicated. In this case, the molten resin is filled in the cavity L1 and solidified, then first the slide mold S is moved in the horizontal direction of the figure along the arrow to separate it from the upper mold J1, then the upper meld J1 and lower mold K are moved in the upper and lower directions so as to open the mold and take out the shaped article, that is, the motor holding housing 2*x*.

In the above way, the present embodiment can provided a blower system which is easy to maintain ant can obtain motor cooling air from the inside of the spiral casing.

Other Embodiment

The inlet opening 2*a* may also use the first passage floor 2*n* as an inclined wall and be formed to be inclined with respect to the diametrical direction of the spiral casing so as to enlarge the passage cross-sectional area in the diametrical direction toward the outside.

While the invention has been described with reference to specific embodiments chosen for purpose of illustration, it should be apparent that numerous modifications could be made thereto by those skilled in the art without departing from the basic concept and scope of the invention.

The invention claimed is:

1. A blower system provided with:

a centrifugal type blower fan for blowing air, taken in through a suction port from an axial direction, to an outside in a diametrical direction of said centrifugal type blower fan, a motor for driving rotation of said centrifugal type blower fan, a blower case in which is formed a spiral casing guiding air sent by said centrifugal type blower fan outward in the diametrical direction to a discharge port, and a motor holding housing for holding said motor, said blower case and said motor holding housing being separate members, said spiral casing being provided with an enlarged part enlarged in an axial direction to a side opposite from said suction port, said motor holding housing being provided with a holder storing and holding said motor, an extension extending from said holder in the diametrical direction of said fan, a circumferential wall connected with said extension and forming an inner circumferential wall of said enlarged part of said spiral casing, and a cooling air passage provided between said holder and said circumferential wall and guiding part of the air circulating inside said spiral casing to said motor, and said cooling air passage having an inlet into which air flows from said spiral casing and an outlet out of which air flows to said motor; wherein said inlet is provided with inclined walls formed inclined with respect to said diametrical direction so as to enlarge the cross-sectional area of the cooling air passage toward the outside in the diametrical direction of the centrifugal type blower fan.

2. A blower system as set forth in claim 1, wherein said cooling air passage is provided with a partition wall formed continuous with said extension and covering said blower fan side of said cooling air passage.

3. A blower system as set forth in claim 2, wherein said partition wall extends from a location where said inclined walls approach each other, closest to an axial center side of said motor.

4. A blower system as set forth in claim 1, wherein said holder has a side wall holding a side of said motor and a floor holding a motor bottom, said outlet is provided near said floor, and said cooling air passage is provided with a first passage extending from said inlet toward said side wall of said holder and a second passage connected with said first passage, extending along said side wall of said holder leading to said outlet.

5. A blower system as set forth in claim 4, wherein an end of a partition wall at a spiral casing side formed continuous with said extension and covering said blower fan side of said cooling air passage and an end of a first passage floor forming said first passage are positioned on the same plane parallel to the axial direction of said motor.

6. A blower system as set forth in claim 1, wherein said inlet is arranged between a spiral start and a spiral end of a spiral shape forming a functional part of said spiral casing and corresponding to a position shifted from said spiral start to said spiral end in a direction opposite to the spiral direction.

7. A blower system as set forth in claim 1, wherein a bottom of said spiral casing is formed on the same plane perpendicular to the motor axis from a spiral start to a spiral end of said spiral casing.

8. A blower system provided with:

a centrifugal type blower fan for blowing air, taken in through a suction port from an axial direction, to an outside in a diametrical direction of said centrifugal type blower fan, a motor for driving rotation of said centrifugal type blower fan, a blower case in which is formed a spiral casing guiding air sent by said centrifugal type blower fan outward in the diametrical direction to a discharge port, and a motor holding housing for holding said motor, said blower case and said motor holding housing being separate members, said spiral casing being provided with an enlarged part enlarged in an axial direction to a side opposite from said suction port, said motor holding housing being provided with a holder storing and holding said motor, an extension extending from said holder in the diametrical direction of said fan, a circumferential wall connected with said extension and forming an inner circumferential wall of said enlarged part of said spiral casing, and a cooling air passage provided between said holder and said circumferential wall and guiding part of the air circulating inside said spiral casing to said motor, and said cooling air passage having an inlet into which air flows from said spiral casing and an outlet out of which air flows to said motor; wherein said holder has a side wall holding a side of said motor and a floor holding a motor bottom, said outlet is provided near said floor, and said cooling air passage is provided with a first passage extending from said inlet toward said side wall of said holder and a second passage connected with said first passage, extending along said side wall of said holder leading to said outlet; and said second passage is formed with an opening at an opposite side from said blower fan, said opening is provided with a lid, and an end of a partition wall at the spiral casing side formed continuously with said extension and covering said blower fan side of said cooling air passage and an end of said opening at the spiral casing side are positioned on a plane parallel to an axial direction of said motor.

* * * * *